United States Patent [19]

Hutchins

[11] Patent Number: 4,790,129

[45] Date of Patent: Dec. 13, 1988

[54] GROUND CONTROL

[75] Inventor: Warwick Hutchins, Coburg North, Australia

[73] Assignee: Rock Engineering Pty. Limited, Victoria, Australia

[21] Appl. No.: 942,953

[22] Filed: Dec. 17, 1986

Related U.S. Application Data

[63] Continuation of Ser. No. 736,344, May 21, 1985, abandoned.

[30] Foreign Application Priority Data

May 22, 1984 [AU] Australia ..... PG5113

[51] Int. Cl.[4] ..... F16B 13/02

[52] U.S. Cl. ..... 57/204; 57/206; 405/260

[58] Field of Search ..... 57/200, 204, 205, 206, 57/212, 215, 234, 236; 405/262, 260, 261; 52/698, 704, 309.1, 659, 675, 676

[56] References Cited

U.S. PATENT DOCUMENTS

| | | | |
|---|---|---|---|
| 626,621 | 6/1899 | L'Hoir et al. | 57/204 X |
| 2,546,977 | 4/1951 | Clary et al. | 57/58.55 |
| 2,961,010 | 11/1960 | Berry | 57/204 X |
| 3,389,561 | 6/1968 | Taylor | 405/260 |
| 3,559,275 | 2/1971 | Slater | 24/115 M X |
| 3,852,930 | 12/1974 | Naaman | 52/659 X |
| 4,333,306 | 6/1982 | Yamashita et al. | 57/206 |
| 4,360,292 | 11/1982 | Keeler et al. | 405/260 X |

FOREIGN PATENT DOCUMENTS 1059351 7/1979 Canada .

*Primary Examiner*—Stuart S. Levy
*Assistant Examiner*—Joseph J. Hail, III
*Attorney, Agent, or Firm*—Larson and Taylor

[57] ABSTRACT

A cable bolt for ground control which is made from individual twisted wires which may be obtained from destranding a wire strand, the cable bolt being made by twisting the wires in a direction opposite their normal twist, the cable bolt so formed having alternate areas of enlarged diameter where the wires are spaced from one and other and areas where the wires lie closely adjacent. A method of manufacturing such a cable bolt by twisting a number of wires into a strand having a twist, at least along part of its length, opposite to the original twist of the wires and which has alternate areas of enlarged diameter where the wires are spaced one from the other and areas where the wires lie closely adjacent. Also there is provided an apparatus to form such a cable bolt which includes a mechanism to receive individual ones of the wires and whereby these can be twisted to form the cable bolt.

3 Claims, 4 Drawing Sheets

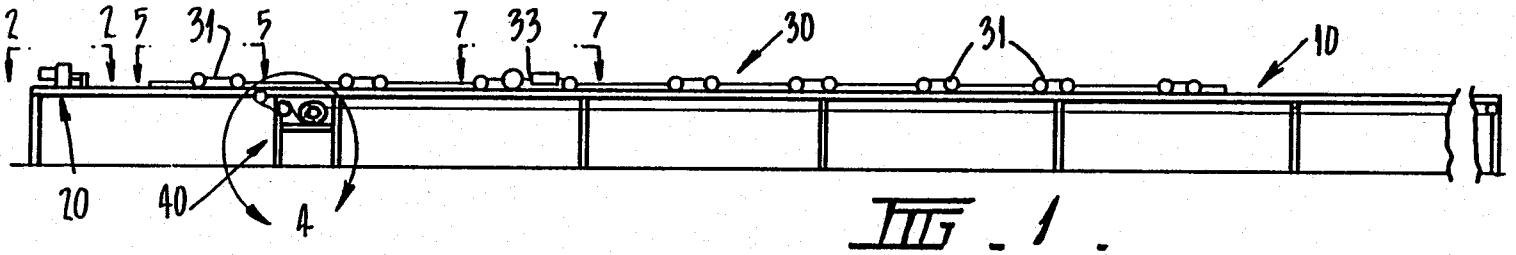
FIG. 1.
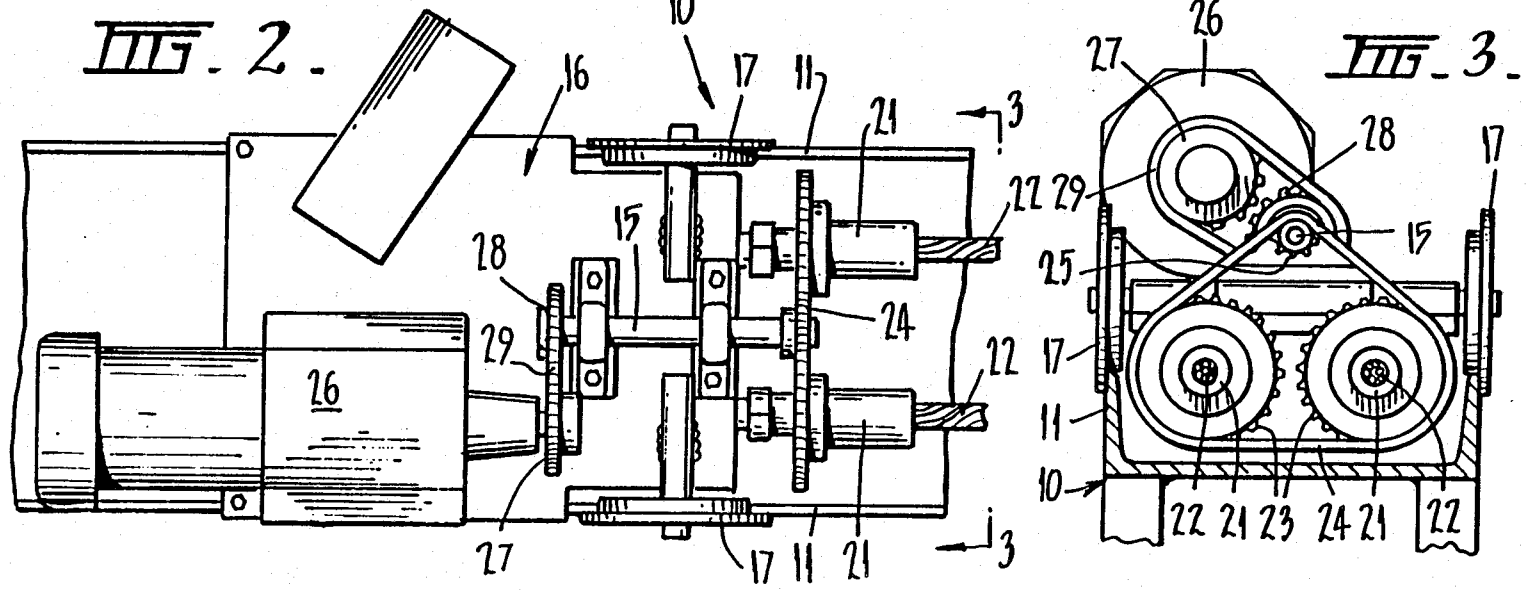
FIG. 2.
FIG. 3.

GROUND CONTROL

This application is a continuation of application Ser. No. 736,344 filed 5/21/85 now abandoned.

This invention relates to ground control and, in particular, to an improved wire strand for cable bolting applications, its method of manufacture and apparatus therefor and to a yielding support for use with cable bolts or the like.

The technique of cable bolting is well known in the mining industry and will only be described briefly as background.

Cable bolts normally comprise flexible strands of high tensile stress relieved steel cable which normally have a single central wire and six wires laid thereabouts in parallel spirals. Whilst this particular formation is stated to be normal, there are other strands used in this application which have as many as 19 or 37 wires which have a single central wire and the remainder wrapped thereabout.

In the simplest form of cable bolt, the cable bolt may be provided with retaining means which comprise a pair of arms of wire held to the cable adjacent to its leading end and/or at various positions along its length, the arms extending outwardly and 'rearwardly' from the cable bolt, the arrangement being such that the cable can be placed into a bore hole of, say, 50 to 70 millimeters in diameter and axial movement from the hole is restricted by these outwardly directed arms, which contact the bore hole wall on outward movement. These arms do not assist in the operation of the cable bolt, but simply act to retain this until grouting is effected.

The bore hole is then filled with a cement grout.

More usually, in practical applications, the cable bolt may comprise a pair of strands which may be interconnected in a spaced manner at distances along the length of the bolt and in some applications each strand may have at predetermined distances along its length a barrel located thereabouts to increase the effective diameter of the strand. In some practical forms each individual strand may be provided with indents or the like along its length to assist the frictional interengagement with the grout column.

Cable bolts can be used in a number of different applications in mines, such as for underground stoping, for pillar support, for development support, and in open pit applications and, generally, holes are drilled through the ground normally into more solid strata into which the bolts are passed and located by the grouting.

Normally it is not necessary to pre-tension the bolts, but they do come into tension when there is any movement of the strata and in an area which is to be stabilized the bolts are located in a pattern which is determined largely by the geological formation to stabilise the wall or roof into which the bolts are passed In some mining applications the bolts pass through the ore body to be mined and as portion of the body this is removed by blasting so the bolts are exposed and they can then be cut off if necessary.

In other applications the bolts pass through unstable material which is not part of the ore body and, by stabilising this, prevents materials from mixing with the ore body thereby diluting the ore, increasing the volume to be treated and accordingly increasing the cost of winning the mineral values.

A major factor in the effectiveness of cable bolts is in the friction between the bolt and the grout, and if this can be increased there is an increase in the force necessary to cause breaking away of adjacent material and, in the optimum, it would be desirable that a bolt support a load effectively up to its tensile strength before the adjacent rock separates therefrom.

It is an object of the invention to provide a strand for cable bolts which has properties which are greater than those previously obtainable, using the same weight of material.

The invention in its broadest sense comprises a cable bolt in which the wires of the cable bolt, over at least part of its length, are twisted in the direction opposite to the original twist and held at each end after twisting thereby providing a cable bolt which has alternate areas of enlarged diameter where the wires are spaced, one from the other, and areas where the wires lie closely adjacent.

In a modification, the strand is made from wires which are plain or indented wires crimped along their lengths and then gathered and held at one end and twisted in a direction opposite the crimp whereby the formed strand has alternate areas of enlarged diameter where the wires are spaced, one from the other, and areas where the wires lie closely adjacent.

In some applications, the cable has additional wires which are located against the original wires after they have been destranded and before they are twisted in the opposite direction.

The invention also includes a method of forming a wire strand from a formed twisted strand having a number of wires comprising the steps of destranding the wires whilst one end of the strand is held and twisting the wires in the opposite sense to restrand the wires but with areas of the strand of a diameter larger than the original area and areas where the diameter is of the same order as the original diameter, and holding the wires at the free end.

The method may comprise an initial step of taking plane or indented wire, forming a repeating crimp along its length, grouping the required number of crimped wires, holding these at one end and twisting the wires in a direction opposite the direction of crimp to strand the wires.

The invention also includes a method of forming a wire strand in which a number of additional wires which have previously been stranded are formed into the strand when it is twisted in the opposite sense.

The invention also includes an apparatus for making a cable bolt including a table or base, a number of elongate wire receiving members adapted to receive at least the number of wires required in the finished cable bolt, the wire receiving members being rotatable, as a group, about an axis parallel to those of the individual wire receiving members, a headstock or the like in which one end of wires received in the receiving members can be held, and means to rotate the wire receiving members whilst there is relative axial movement between the headstock and the wire receiving members.

The chambers may preferably be tubes located coaxially and in substantially the pattern of the wire in the original strand.

In order that the invention may be more readily understood and put into practice, we shall describe one embodiment of the invention which is illustrated in the accompanying drawings, in which:

FIG. 1 is a side elevation of the apparatus of the invention;

FIG. 2 is a plan view along line 2—2 of FIG. 1 showing the headstock of the device;

FIG. 3 is a partial section looking at the headstock along line 3—3 of FIG. 2;

Figure 4:
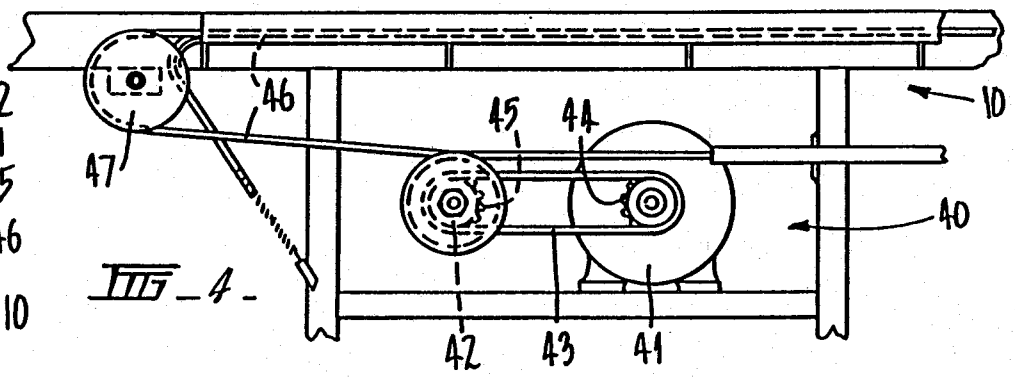
FIG. 4 is a view of the area marked as 4 on FIG. 1 and shows the drive means to move the turret assembly.

In this description we shall use terminology conventionally used in the industry and a cable bolt is flexible and normally comprises one or two strands of high tensile stress relieved steel cable. Each strand consists of a number of wires, conventionally seven of which the centre wire runs straight through the strand and the outer wires are helically wound around the centre wire in close contact so that any section of the strand shows the centre wire surrounded by six outer wires each of which is in contact with its two adjacent wires and the centre wire.

Each wire may be smooth but, preferably, to increase the frictional engagement between the wire and the grouting in which the cable bolt is embedded, the wire may have indents or the like along its length.

Normal cable bolts are terminated at each end, either by a ductile member which is deformed around the bolt or by a barrel and wedge.

In this specification, in order to differentiate the reformed strands from the initial strands from which they are formed, we shall describe the reformed strands as cable bolts or cable bolt lengths.

Further, whilst in this specification we describe a batch process for the formation of cable bolts, it will be appreciated that the cable bolts could be made in a continuous process.

Referring firstly to FIG. 1, the table or bed 10 illustrated is designed for batch treatments of cable bolt lengths and has a length which is approximately twice the length of the strands.

Basically, the operative portion of the apparatus comprises a headstock 20 at one end of the table and a trolley mounted turret arrangement 30 which is adapted to move forwardly and rearwardly along the table and which is driven by a drive means 40.

Referring firstly to the headstock, this is built about a pair of chucks or collets 21, each of which is adapted to receive a wire strand 22 in an engagement whereby the strand can be rotated about its axis.

Each chuck 21 is mounted for rotation and for this purpose is provided about its periphery with spur gear 23. These spur gears are connected by a chain 24 to a driving gear 25 which, in turn, is driven by motor 26 through gears 27, 28 which are interconnected by chain 29, gear 28 driving shaft 15 to which gear 28 is connected.

The whole of the stock assembly is mounted on a carriage 16 having wheels 17 which engage with the flanges 11 of the table 10.

The turret assembly 30 consists of a number of trolleys or trucks 31, each of which have flanged wheels 32 which ride on the flanges 11 of the table 10 and a single trolley or truck 33 which is located behind the first of the trolleys 31 and which is different in construction from the earlier trolleys.

Figure 5:
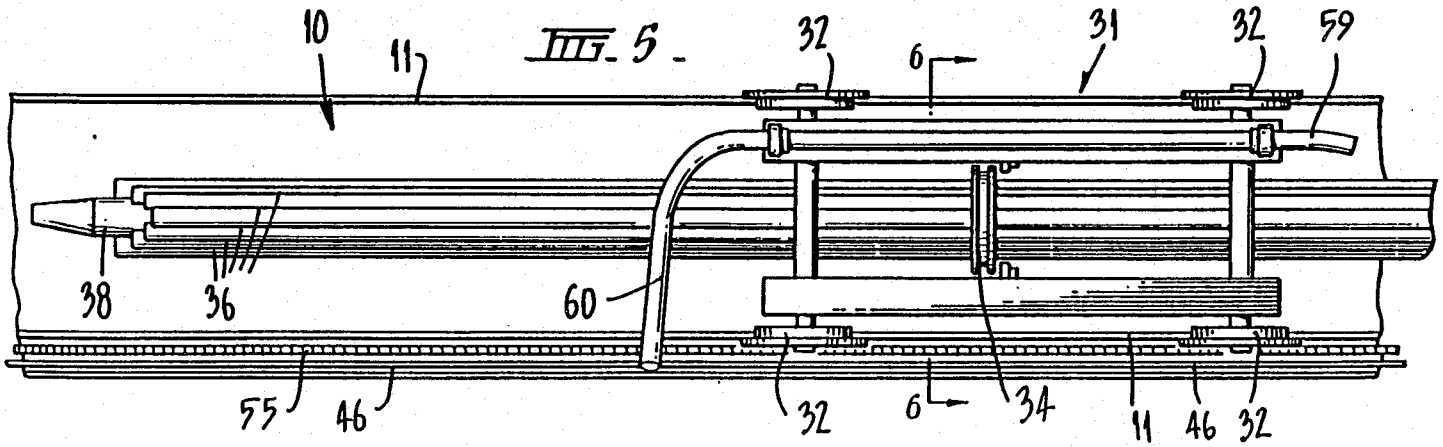
FIG. 5 is a plan view along line 5—5 of FIG. 1 which shows the leading end of the turret assembly and, specifically, one of the trolleys or trucks used therewith.
Figure 6:
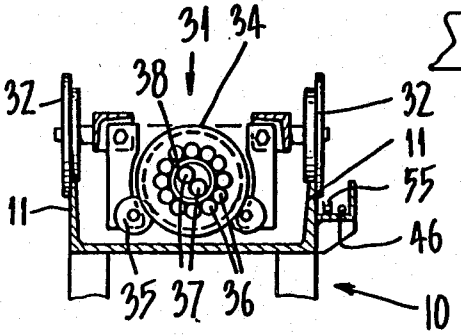
FIG. 6 is a view of the trolley or truck of FIG. 5 looking along line 6—6 of FIG. 5.
Figure 7:
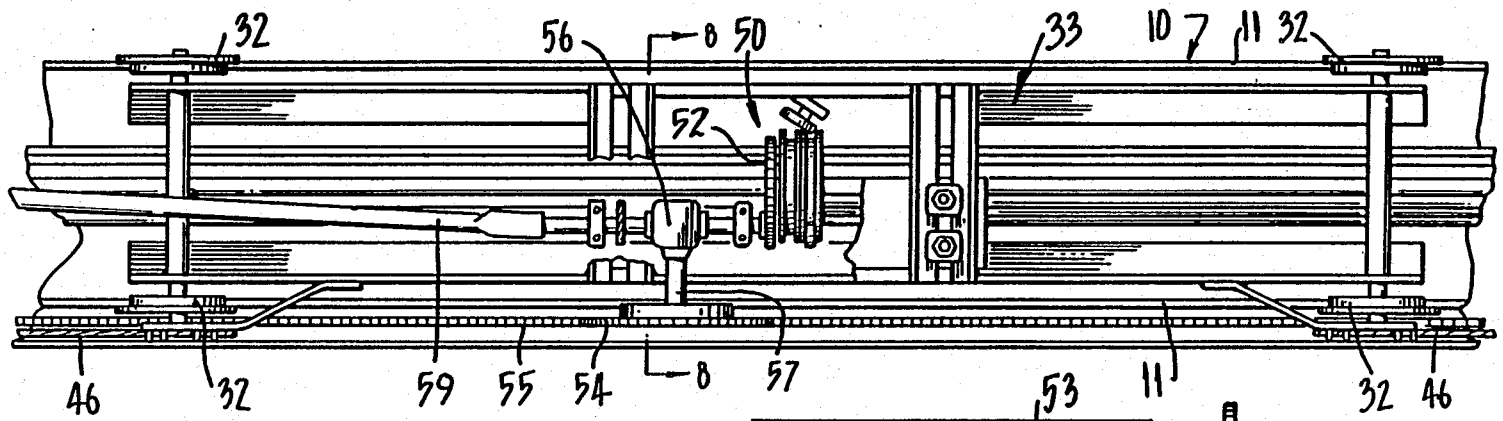
FIG. 7 is a plan view along line 7—7 of FIG. 1 and shows a further part of the turret assembly and, specifically, the driven part of the turret assembly.

Referring first to FIGS. 5 and 6, the trolley 31 is provided with a receiving member 34 which is mounted for rotation on idlers 35 and which is retained against axial movement by these idlers. Located in and passing through apertures in the receiving member, there are a number of peripherally arranged tubes 36, as illustrated there are some twelve of these, and a pair of central tubes 37.

The tubes 36, as can be seen from the left side of FIG. 5 terminate at slightly different distances, as will be described hereinafter, and the central tubes 37 are located in a surround 38 which extends forwardly of the various tubes.

It will be appreciated then that the tubes 36, 37 and the surround 38 extend rearwardly through each of the trolleys 31, and the trolley 33 and the total length of these tubes is approximately equal to the total length of the wire strands to be used.

As mentioned, the trolley 33 differs from the other trolleys in that, in this case, the receiving member 50, whilst mounted on rollers 35 in a manner similar to the receiving members 34 which has an internal configuration the same as the earlier described members, has an external spur gear 51 which is driven by chain 52 from a gear 53 which is rotated through a gear box 56 by rotation of a shaft 57 driven by a pinion 54 which moves along a rack 55 formed on the table 10.

Figure 8:
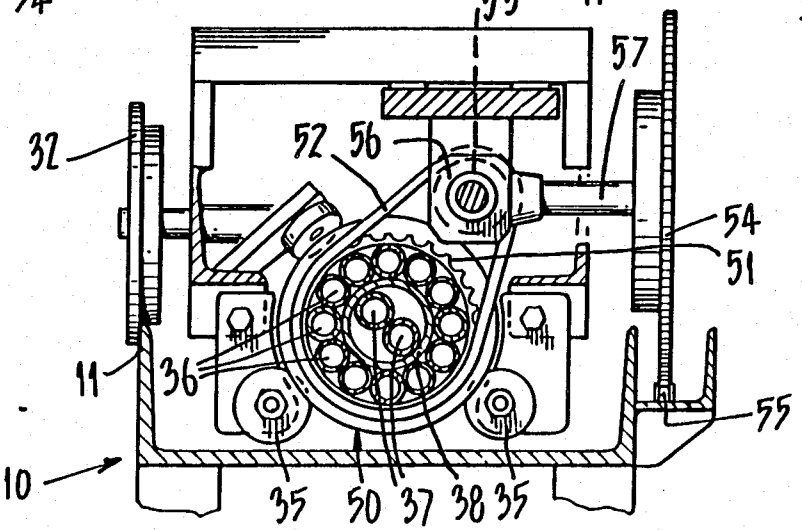
FIG. 8 is a view along line 8—8 of FIG. 7 showing the means whereby the turret assembly is rotated as the trolleys or trucks thereof move along the apparatus.
Figure 9:
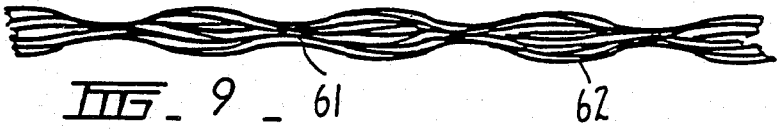
FIG. 9 is a side elevation view of the cable bolt material made in accordance with the invention.
Figure 10:
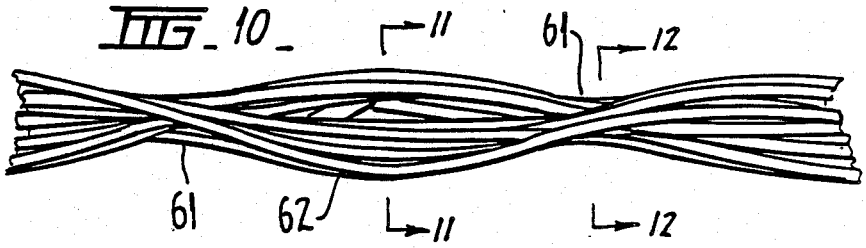
FIG. 10 is an enlarged view of one node of the cable bolt of FIG. 9.
Figure 11:
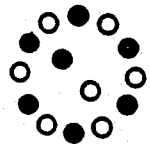
FIG. 11 is a sectional view along line 11—11 of FIG. 10 looking in the direction of the arrows and showing the substantial spacing of the wires.

This is the position illustrated in FIG. 8 and it will be appreciated that as the trolleys 31 and 33 move along the table, so the pinion 54 will rotate causing rotation of the receiving member 50 and thus rotation of the whole of the set of tubes and other receiving members located on the trolleys.

It is possible to rotate the shaft 57 so that the pinion 54 becomes disengaged from the rack and, as illustrated, we provide a lever arm 59 which extends forward to the front trolley 31 which has a handle 60 formed thereon, the arrangement being that, on rotation of the handle, so the arm 59 rotates causing partial rotation of the pinion 54 and the disengagement of this from the rack 55.

The trolleys can be moved forwardly and rearwardly along the table by the drive means 40 illustrated in FIG. 4.

We provide a motor 41 which drives a pulley 42 by means of chain 43 and spur gears 44, 45 and pulley 42 is in connection with an endless cable 46 which passes over idler roller 47, as illustrated in FIG. 4, and over a similar idler roller, not illustrated, adjacent the end of the machine away from the headstock.

The cable 446 is in connection with the trolleys of the turret assembly, whereby, depending upon the direction of rotation of the motor 41 or the setting of the gear box, so the turret assembly can be moved towards or away from the headstock 20.

In operation, the turret assembly is moved to the end of the table away from the headstock, by means of the motor 41 and cable 46, and the strands to be converted into the strand of the invention are laid along the table and one end of each of these strands is connected to one of the chucks 21.

The turret assembly is moved until the free ends of the strands are closely adjacent the surround 38 and the ends of the strands are partially destranded and the individual wires are each placed into one of the tubes 36 or 37.

It will be seen that as the ends of these tubes terminate at different distances, the wires can be sequentially passed into the tube so there is no difficulty in locating these.

The pinion 54 is moved away from the rack 55 by operation of the handle 60 and the turret assembly is caused to move towards the headstock, by operation of the motor 41 causing mounting of the cable 46 and, at the same time, the motor 26 of the headstock is operated so as to tend to unwind the strands in the chucks 21.

Thus unwinding takes place at a speed which is comensurate with the speed of movement of the trolley so that the wires are at all times fed into their associated tube in a straight line.

Of course, there will tend to be variation from this but, generally, the wires can be readily fed and the wires are held in the tubes.

It will be appreciated that the wires in the tubes are under substantial restraint as each wire would normally attempt to assume a spiral formation similar to the position of the wire in the original strands.

When the whole of the strands are effectively twisted, the ends of the strands adjacent the headstock may remain in their normal condition or, if required, the headstock could be caused to move towards the end of the turret assembly so a very substantial part of the total wire strand is unwound.

In order to form the cable bolt of the invention, it is then necessary to restrand the wires with the twist being in the direction opposite that of the original strands.

Before describing this we will state that, in the preferred embodiment, we have taken two strands and destranded these by location of the wires of the strands in the tubes with the two centre wires being into the two centre tubes 37, but it will be appreciated that the invention could equally well be applied to a single strand or, if it is desired, not all of the wires of each of the strands may be used.

We prefer to use the wires of two strands simply to make a cable bolt which, as will be described later, has characteristics equivalent to conventional cable bolts comprised of two spaced strands, as previously discussed.

Once the destranding is complete, the pinion 54 is brought into engagement with the rack 55 and, thus, when the turret trolleys 31 and 33 commence to move away from the headstock 20, the receiving member 50 is caused to rotate and rotation of this causes a corresponding rotation of the tube 36, 37 and the other receiving members 34.

This direction of rotation is in the direction opposite to the direction of unravelling.

The speed of rotation may be such that the required end result is achieved by the rotation of the receiving member 50, and thus the tubes and other receiving members.

This result is well illustrated in FIG. 9 to 12.

Figure 12:
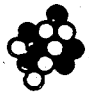
FIG. 12 is a view along line 12—12 of FIG. 10 showing the close bunching of the wires at the point of intersection.

We have found that the completed cable bolt has a series of nodes 61 in which the wires are in a position very similar to that they would have been in a conventional strand, see specifically FIG. 12. It will be appreciated that the arrangement is not as symmetrical as a normal strand, as the cable bolt has two centre wires and twelve outer wires instead of a single centre wire and six closely adjacent outer wires as is the case with the strands used in the formation thereof.

Between these nodes there are parts of an increased overall diameter where the wires are all substantially spaced from one another and the arrangement is such that, at this area, the outer diameter is such as to be a relatively close fit in a bore hole.

This operation, considered in relation to a seven wire strand having nominal five millimetre wires, having a nominal diameter of approximately fifteen millimetres and having a pitch of approximately 210 mm, but not limited thereto, forms nodes approximately at the positions of pitch lengths of the strand and, depending on the degree of opposite twist, so the diameter of the strand between the nodes is greater or lesser, the greater the twist the lesser the diameter. Thus it is possible, depending on the degree of twist, to form a strand which has a diameter suitable for various size bore holes.

Once twisting has been completed we find that at the nodes the wires lie very much in the form in which they would have laid in the original strand and the strand is basically coherent in itself.

If required, and in particular, if a plate or other restraining member is to be provided at one or both ends of the cable bolt, the wires of the strand can be held, during manufacture, adjacent the end and the twist applied at the end is the same as the original twist of the strand so that the end of the strand is basically conventional and having a constant diameter and can be terminated in conventional ways, say by using barrels and wedges.

When the complete cable bolt has been formed, the ends are held together by some form of clamping assembly, as is conventional, and the cable bolt can then be handled in a way very similar to normal strands, that is it can be coiled or otherwise prepared for delivery.

Figure 13:
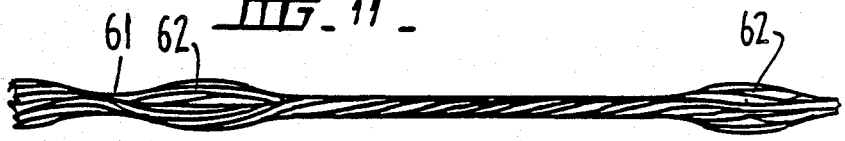
FIG. 13 is a view similar to FIG. 9 showing a different form of cable bolt of the invention.

FIG. 13 is an embodiment which shows an alternate type of cable bolt which can be made by use of the invention and, in this case, the cable bolt has alternate large diameter areas and areas where the cable bolt is effectively similar to a normal strand having the same number of wires.

In order to form a cable bolt in this way, it is necessary to alternate the twisting effect so that part of the strand is twisted to provide the formation of the invention whilst the next remaining part is twisted in the opposite sense to effectively attempt to relay the strand as it was originally laid although, once again, it must be appreciated, in the particular embodiment, as there are twice as many external wires, these cannot lay in the same position as they would if the strand was to be reconstituted.

Subsequent to the formation of this smaller diameter area, then the rotation is again reversed and areas having alternate nodes and enlarged diameter portions are again formed.

We have found that bolts using the strands of the invention give a performance which is substantially superior than that which can be achieved using a similar quantity of wire in more conventional cable bolts.

Figure 14:
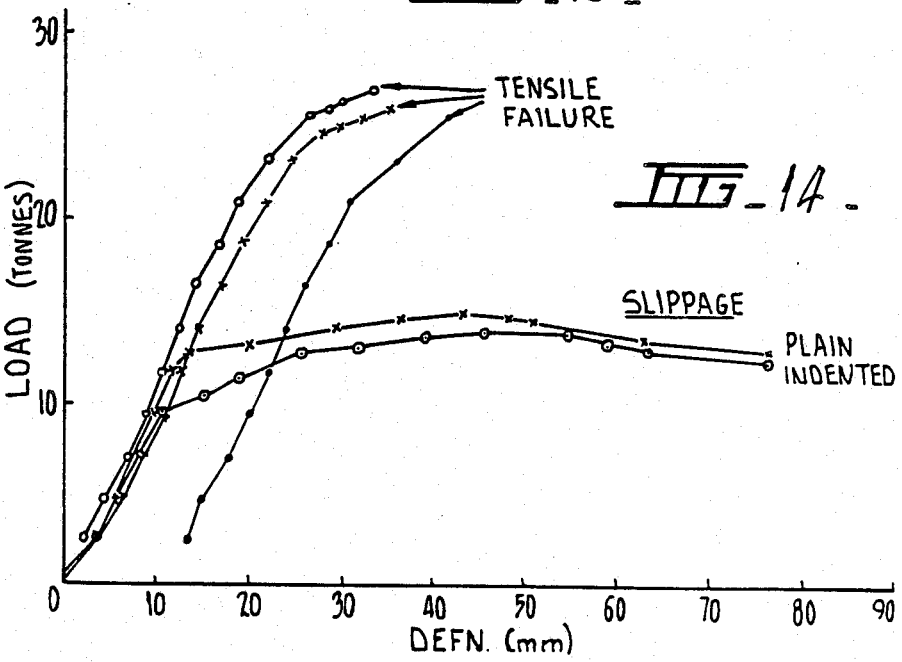
FIGS. 14 is a graph showing the performance of the cable bolt of the invention in operation relative to previous conventional cable bolts made of strand material.

FIG. 14 shows a plot of deformation against load using cable bolts made in accordance with the invention and normal cable bolts.

The cable bolt of the invention, the results of which are plotted as 2, was a seven strand cable bolt, that is it was fabricated from a single initial strand rather than the illustrated arrangement which was made from two strands.

The comparison sample was a $1 \times 15.2$ mm standard strand.

Both of the strands had an estimated 25 tonne tensile strength and it can be seen from the plots that the strands of the invention suffered deformation up to the point of tensile failure, whereas the standard strands all slipped relative to the grout well before tensile failure.

Very similar results have been achieved by using strands having larger numbers of wires and, in comparison, between strands made in accordance with the illustrated embodiment and two strand cable bolts which have been conventionally used in the art.

I claim:

1. An improved cable bolt of high tensile strength for ground control made from a standard cable bolt comprising a plurality of individually twisted wires of a constant pitch, said improved cable bolt comprising a plurality of said individually twisted wires which, over at least part of the length of the bolt, are twisted in the direction opposite to the original twist of the wires without rewinding the wires so as to provide between the ends of the wires, a region in which at least the outermost wires each follow a path of the shape of a single simple regular helix and these outermost wires together form at least three successive areas of enlarged diameter wherein the wires are spaced, one from the other, and are separated only by nodes therebetween wherein the wires lie closely adjacent to one another but are not wound or rewound one around the other, said nodes being of very short length as compared with the lengths of the areas of enlarged diameter and the distance between the centers of the said nodes being substantially equal to the pitch length of the wires of the standard cable bolt.

2. An improved cable bolt as claimed in claim 1 including areas wherein the wires of the cable bolt are twisted in the direction opposite to the original twist and alternate areas wherein the wires of the cable bolt are twisted in the same direction as the original twist.

3. An improved cable bolt of high tensile strength for cable bolting application in ground control made from a standard cable bolt comprising a plurality of individually twisted wires of a constant pitch, said improved cable bolt comprising a plurality of said individually twisted wires which, over at least part of the length of the bolt, are twisted in the direction opposite to the original twist of the wires without rewinding the wires so as to provide between the ends of the wires, a region in which the wires follow a path of the shape of a single simple regular helix and these outermost wires together form at least three successive areas of enlarged diameter wherein the wires are spaced, one from the other, and are separated only by nodes therebetween wherein the wires lie closely adjacent to one another, but are not wound or rewound one around the other, said nodes being of very short length as compared with the lengths of the areas of enlarged diameter and the distance between the centers of the said nodes being substantially equal to the pitch length of the wires of the standard cable bolt, and means for holding the wires of the cable bolt at each end thereto after twisting.

* * * * *